US005390923A

United States Patent [19]

Takemoto et al.

[11] Patent Number: 5,390,923

[45] Date of Patent: Feb. 21, 1995

[54] MEDAL PIECE FEED SYSTEM FOR GAME MACHINES

[75] Inventors: Takatoshi Takemoto, Tokyo; Meiji Muramatsu, Yokohama, both of Japan

[73] Assignee: Kabushiki Kaisha Ace Denken, Japan

[21] Appl. No.: 182,185

[22] PCT Filed: Oct. 11, 1991

[86] PCT No.: PCT/JP91/01392

§ 371 Date: Jan. 27, 1994

§ 102(e) Date: Jan. 27, 1994

[87] PCT Pub. No.: WO93/03805

PCT Pub. Date: Mar. 4, 1993

[30] Foreign Application Priority Data

Aug. 14, 1991 [JP] Japan ..... 3-204079

[51] Int. Cl.[6] ..... A63F 9/00; G07F 17/34

[52] U.S. Cl. ..... 273/148 R; 273/143 R; 273/121 B

[58] Field of Search ..... 273/121 B, 143 R, 138 A, 273/148 R

[56] References Cited

FOREIGN PATENT DOCUMENTS

| | | | |
|---|---|---|---|
| 50-18289 | 2/1975 | Japan . | |
| 4212396 | 8/1992 | Japan | 273/143 R |
| 4312487 | 11/1992 | Japan | 273/121 B |
| WO/9306902 | 3/1993 | WIPO | 273/121 B |

*Primary Examiner*—Benjamin H. Layno

*Attorney, Agent, or Firm*—Andrus, Sceales, Starke & Sawall

[57] ABSTRACT

A medal piece feed system is so constructed that medal pieces A can be fed from holes 2 formed in a bottom 1*a* of a medal piece container 1, into chutes 3 underlying the respective holes. The medal piece feed system has feed cylinders 4, each having its lower part snugly inserted in the corresponding hole 2 and being adapted to be driven and rotated, that are erected inside the medal piece container 1. An acceptance opening 4*a* is formed in a peripheral wall of each feed cylinder 4 which faces the interior of the medal piece container 1, while a delivery opening 4*b* which communicates with the interior of the underlying chute 3 is formed in a base plane of each feed cylinder 4.

7 Claims, 7 Drawing Sheets

FIG. 4
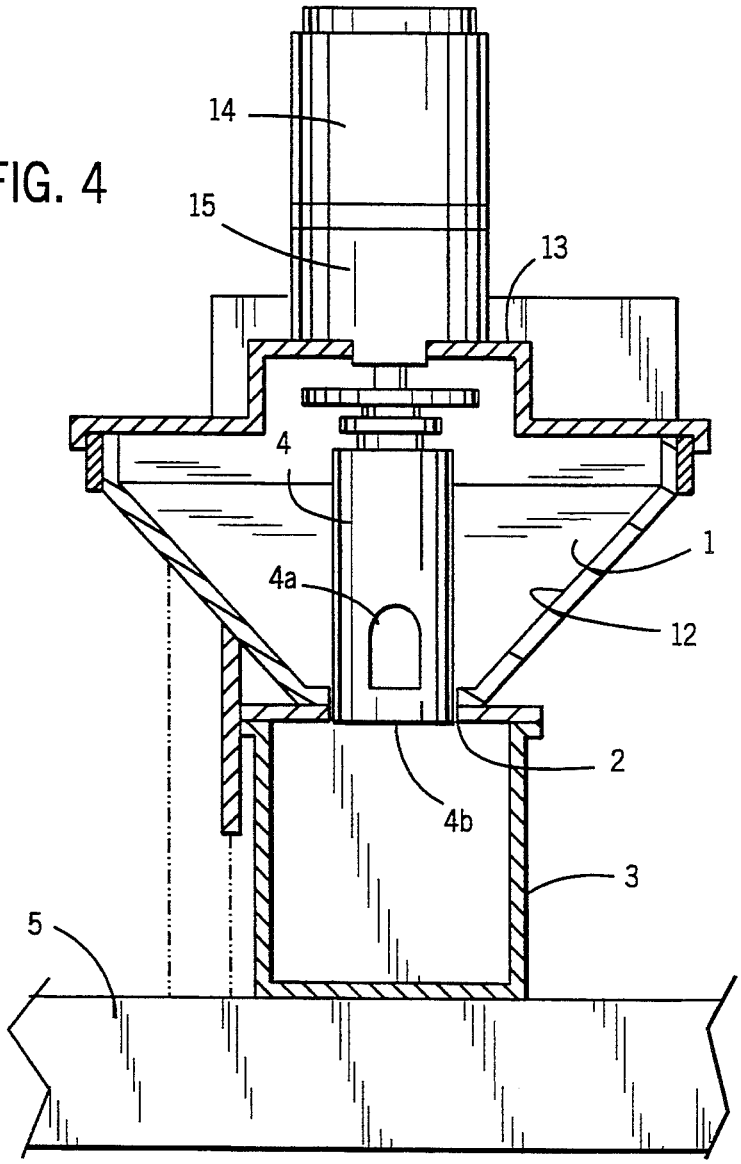
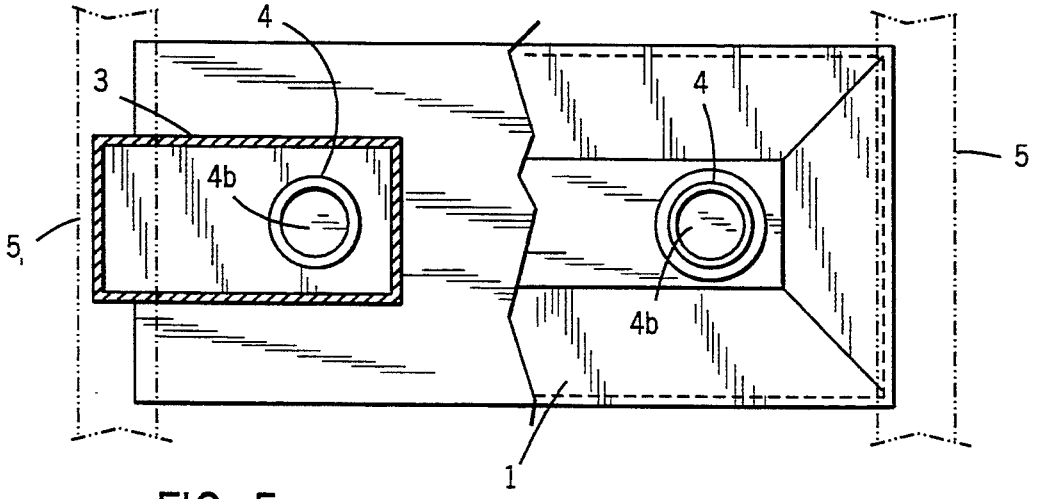
FIG. 5

MEDAL PIECE FEED SYSTEM FOR GAME MACHINES

DESCRIPTION

1. Technical Field

The present invention relates to a medal piece feed system for game machines. More particularly, it relates to a medal piece feed system which is used together with a large number of juxtaposed game machines, for example, slot machines, employing medal pieces as game media and which supplies the medal pieces to the game machines.

2. Background Art

Heretofore, there has been known a medal piece feed system which is so constructed that medal pieces to be supplied to game machines are stocked in a medal piece container, and that the medal pieces can be fed from holes formed in the bottom of the container, through chutes underlying the holes. In this system, the medal pieces in the medal piece container pass through the holes and drop under their own weight so as to be fed into the underlying chutes.

Such a structure, however, has had the problem that the system becomes incapable of feeding the medal pieces in, e.g., a case where a number of medal pieces become linked to one another above each hole and form a so-called bridge, with the result that the medal pieces fail to drop from the holes.

DISCLOSURE OF THE INVENTION

The present invention is contrived so as to solve the problem as stated above and to be capable of significantly enhancing the performance of feeding medal pieces. With this object in mind, a medal piece feed system for game machines is so constructed that feed cylinders, each of which has its lower part snugly inserted into a corresponding hole and can be driven to rotate, are erected inside a medal piece container, and that an acceptance opening is formed in a peripheral wall of each feed cylinder so as to face the interior of the medal piece container, while a delivery opening which is inserted into the interior of the underlying chute in communication therewith is formed in a base plane of each feed cylinder.

In the system of the present invention, the medal pieces may well be coins, a conveyor for resupplying the medal pieces to the game machines can also be extended so as to directly underlie the lower part of said each chute, and each chute may well be in the form of a flexible hose whose lower end is connected to a medal piece introducing fixture. Besides, a motor sensor may well be installed around a rotation driving shaft which is coupled to the upper part of each feed cylinder. Further, friction plates for a clutch may well be interposed between the sides of the rotation driving shaft and each feed cylinder, and a spring which resiliently compresses the friction plates may well be used for making it possible to set a torque.

Accordingly, even when the medal pieces stocked in the medal piece container are in the state where they have become linked to one another and have formed a bridge, they act to press against the feed cylinder within the container. While the bridge formed the medal pieces is being unbalanced by the acceptance opening of the feed cylinder owing to the rotation of this feed cylinder, the medal pieces are directly taken into the feed cylinder. The medal pieces taken into the feed cylinder are sent from the delivery opening thereof into the underlying chute, and are smoothly sent to the individual game machines through the resupply conveyor or the introducing fixtures. In this case, when the medal piece engages with the feed cylinder inside the container by way of example, the feed cylinder sometimes stops its rotation while the friction plates are slipping due to the resulting over-load. This state is detected by the motor sensor, and the attitude of the engaging medal piece around the feed cylinder can be corrected if this feed cylinder is kept reversed for, e.g., about 3 seconds. Thereafter, the feed cylinder is rotated forwards again, whereby the medal pieces can be favorably accepted.

BRIEF DESCRIPTION OF THE DRAWINGS

FIG. 4 is a vertical sectional view showing part of FIG. 1.

FIG. 5 is a bottom view showing part of FIG. 1.

BEST MODES FOR CARRYING OUT THE INVENTION

Figure 8:
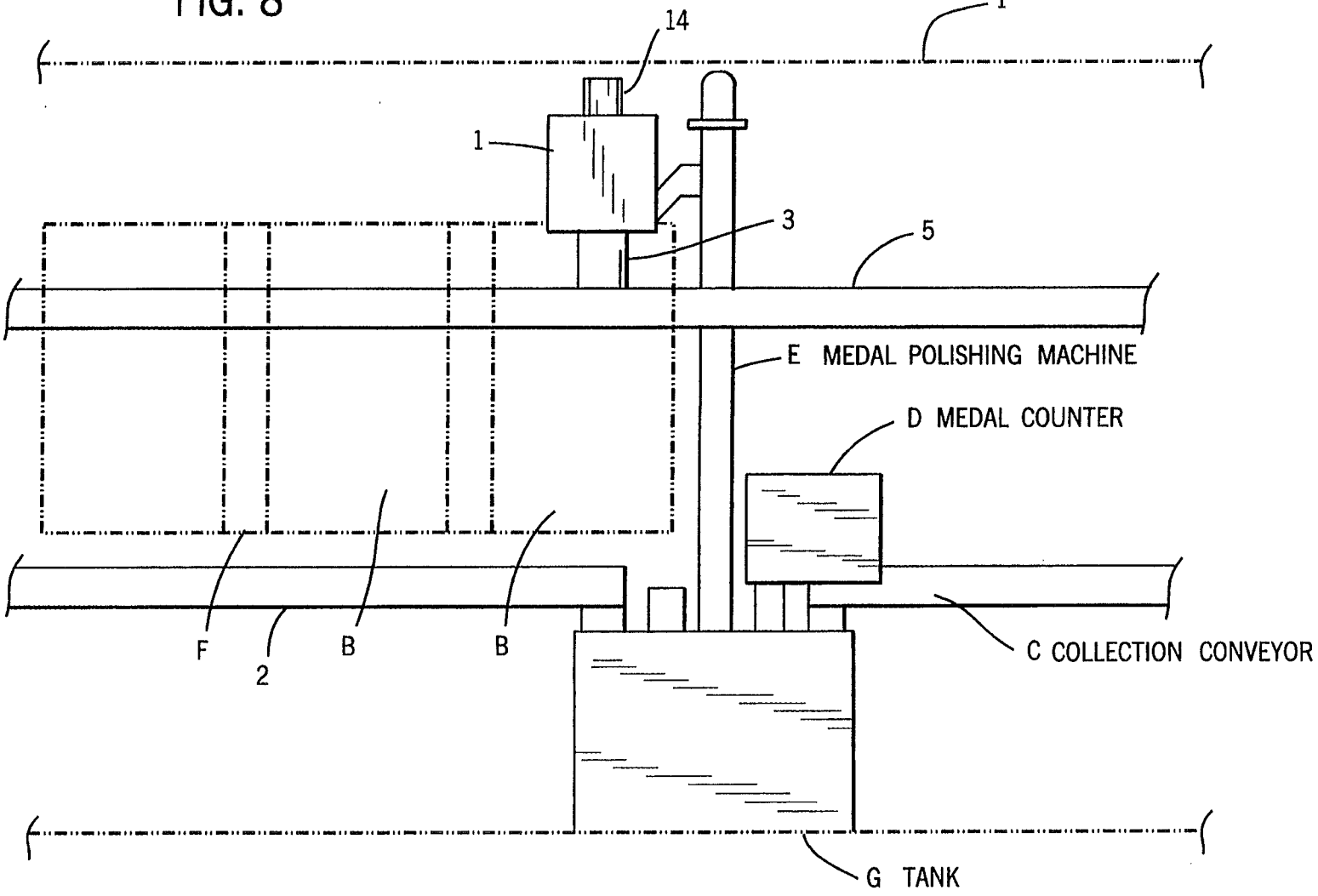
FIG. 8 is a schematic view showing a medal piece collection/supply system in a game machine island.

FIG. 8 shows a game machine island I which is so constructed that game machines, such as slot machines, B employing medal pieces as game media, are juxtaposed in a large number, and in particular, with the medal piece collection/supply system of the game machine island I. In such a game machine island, it is common practice that, after the medal pieces collected through a collection conveyor C from the game machines B have been counted by a medal counter D, they are carried upwards while being polished by a medal polishing machine E which has a helical transport path, so as to be resupplied to the game machines B through a medal piece feed system. In the game machine island I, game medium vending machines F for dispensing the game media such as medal pieces are sometimes disposed between the respectively adjacent ones of the juxtaposed game machines B. In this case, the medal pieces are resupplied also to the game medium vending machines F through the medal piece feed system. Incidentally, the game machine island I can also be furnished with a tank G in which the medal pieces collected by the collection conveyor C are temporarily reserved after the counting operation.

An embodiment illustrated in FIGS. 1 thru 6 is so constructed that medal pieces A collected in a medal piece container 1 can be fed to individual game machines B. The game machines B include, for example, slot machines, ball arrangement machines and mahjong pinball machines. Besides, the medal pieces A may be deemed to include coins and medals for use in, for example, the slot machines, ball arrangement machines and mahjong pinball machines, and other gaming media for use in such game machines.

Figure 1:
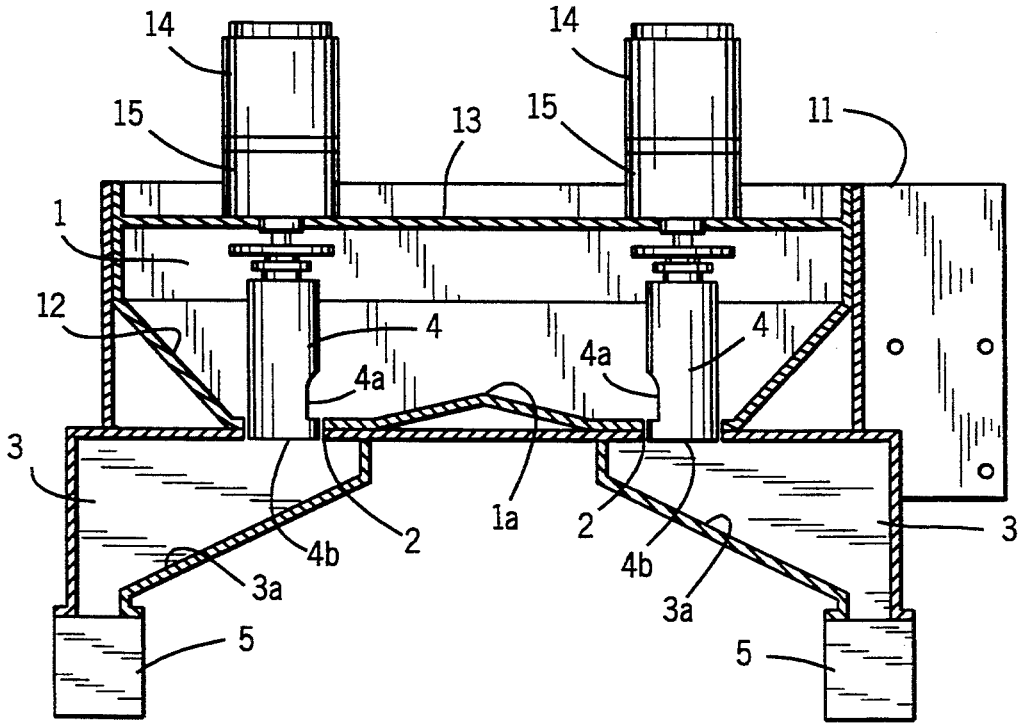
FIG. 1 is a vertical sectional view showing the essential portions of a medal piece feed system which is an embodiment of the present invention.
Figure 2:
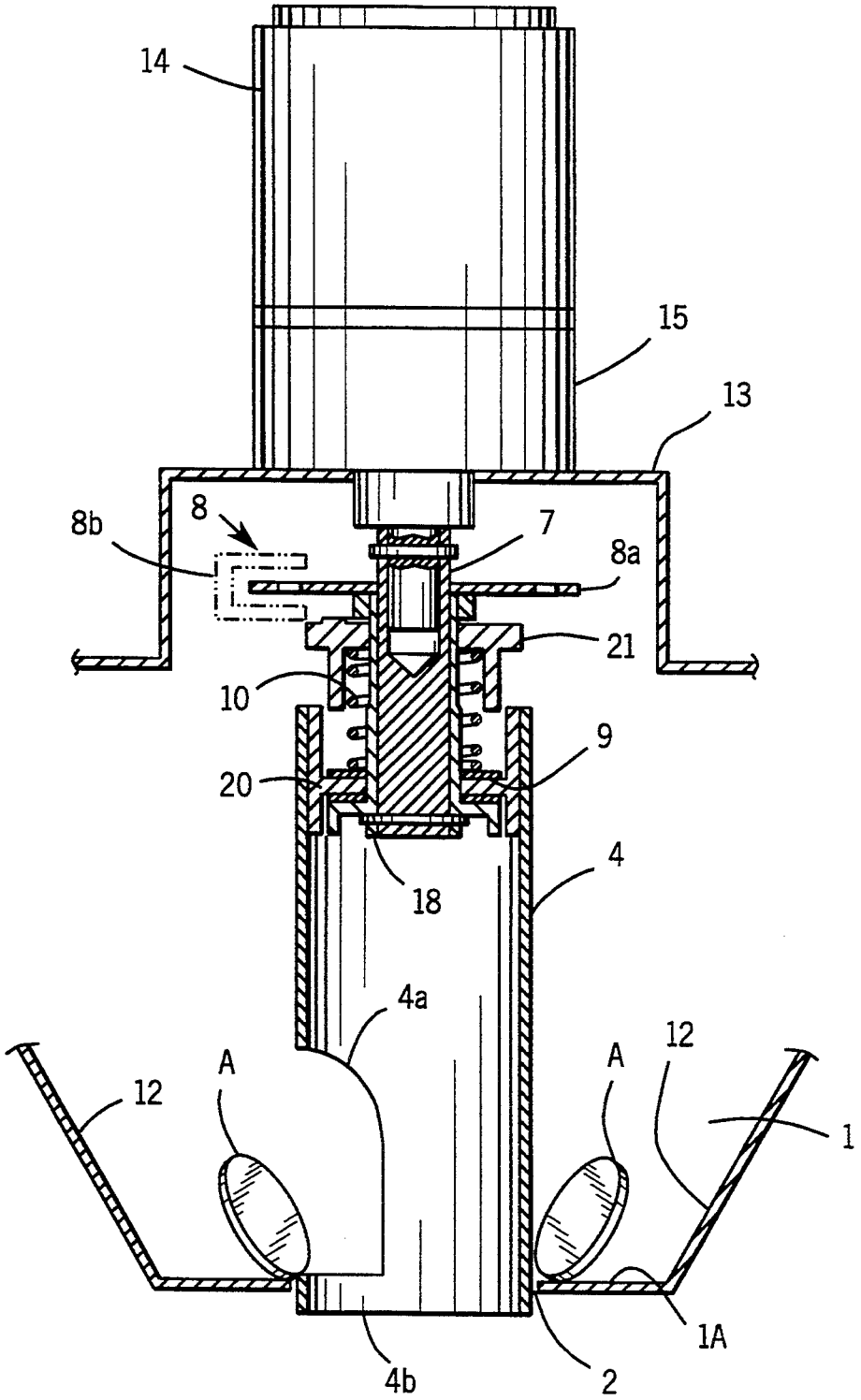
FIG. 2 is a sectional view showing part of FIG. 1 on an enlarged scale.
Figure 3:
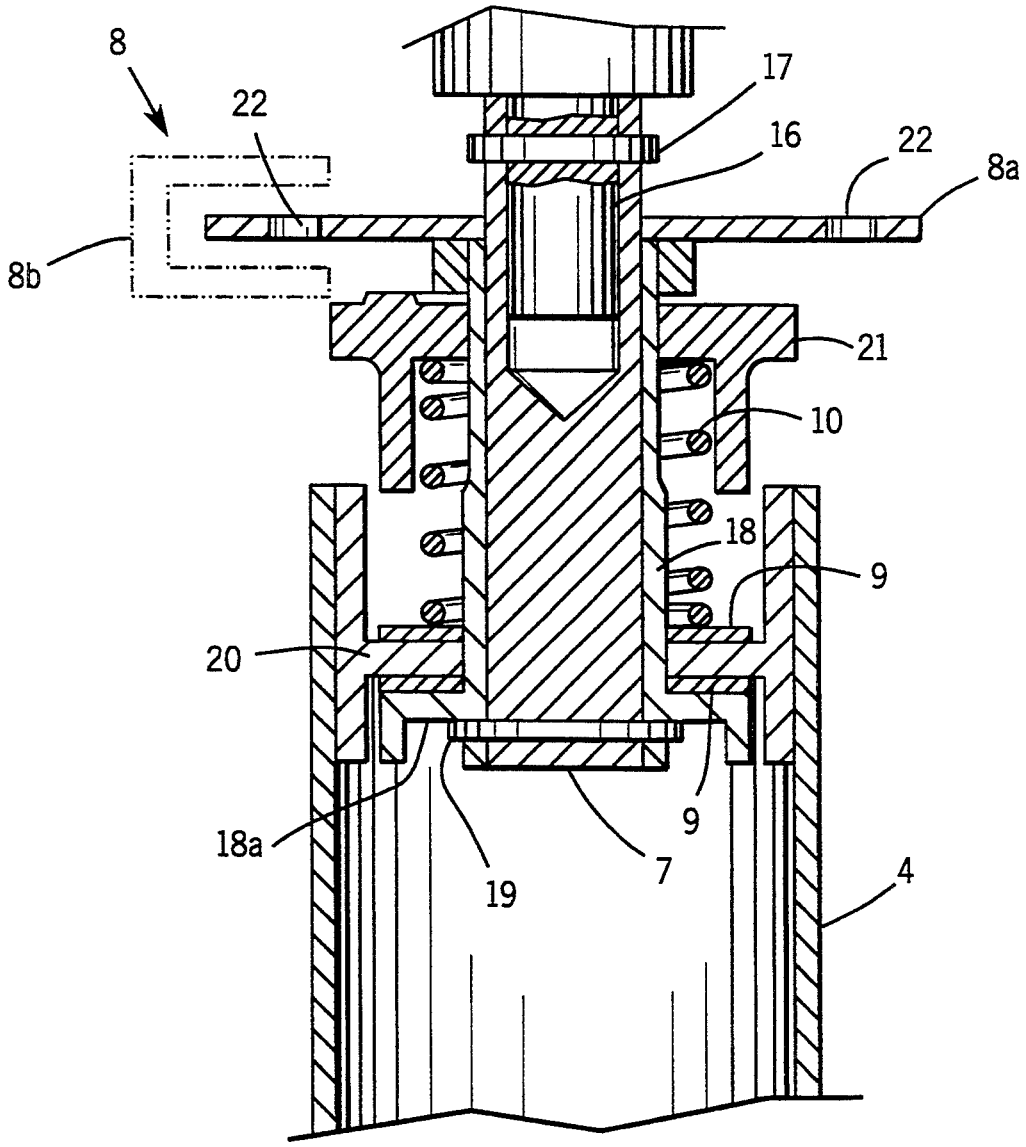
FIG. 3 is a sectional view showing part of FIG. 2 on an enlarged scale.
Figure 6:
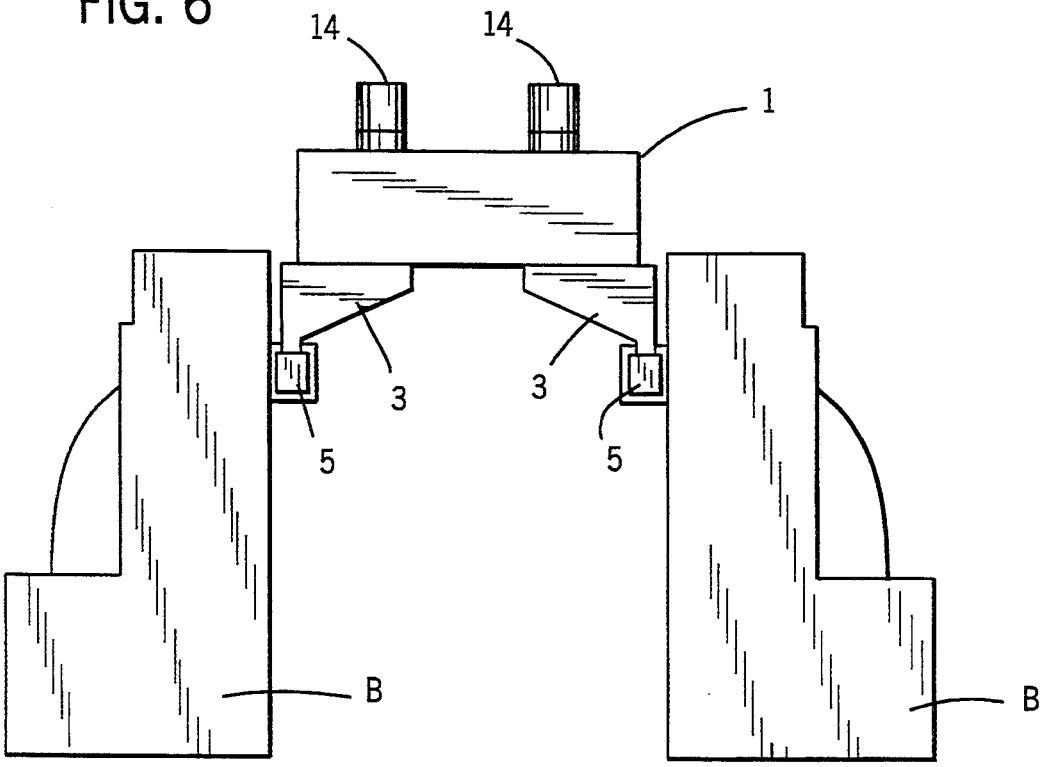
FIG. 6 is a front view showing the state of arrangement of the feed system relative to game machines.

As shown in FIG. 1, the medal piece container 1 is mounted on a bracket 11. It collects and stores the medal pieces A supplied from a medal piece polishing machine, and it has the capacity to receive, for example, 3000 medals. The bottom la of the medal piece container 1 is formed into inclined surface, and an inclined surface 12 is formed around the bottom 1*a*. Circular holes 2, 2 are respectively formed in both the side parts of the bottom 1*a*; two chutes 3, 3 whose bottoms 3*a* are slant surfaces are respectively attached under the holes 2, 2 in communication therewith; and the lower parts of the chutes 3, 3 are directly underlaid with respective conveyors 5, 5 for resupplying the medal pieces to the individual game machines B.

Feed cylinders 4, 4 whose lower parts are snugly inserted into the holes 2, 2 and which can be driven to rotate, are erected inside the medal piece container 1. An acceptance opening 4*a* is formed in the peripheral wall of each feed cylinder 4 facing the interior of the medal piece container 1, while a delivery opening 4*b* which communicates with the interior of the underlying chute 3 is formed in the base plane of the feed cylinder 4. In addition, the feed system is so constructed that the feed cylinders 4, 4 can be respectively driven to rotate by reversible motors 14, 14 overlying a mounting bed 13 which is provided so as to form the upper frame part of the medal piece container 1. A rotary shaft 16 which extends from within a gear case 15 underneath each motor 14, is snugly fitted into the upper part of a rotation driving shaft 7 and is locked by a locking pin 17. The lower part of the rotation driving shaft 7 and that of a tubular shaft 18, which is snugly fitted round this rotation driving shaft 7, are locked by a locking pin 19. A friction plate 9 is interposed between the lower surface of a fixture 20 which is snugly secured to the upper part of the interior of the feed cylinder 4 and the upper surface of a flange 18*a* which is formed at the lower part of the tubular shaft 18. Further, another friction plate 9 is placed on the upper surface of the fixture 20 as an upper friction plate. A spring 10 of compression type capable of setting a torque through an adjuster 21 is retained between the upper friction plate 9 and the adjuster 21 which is threadably mounted on the upper part of the tubular shaft 18. Disposed around the upper part of the rotation driving shaft 7 is a motor sensor 8 which includes a photosensor 8*b* as well as a disc 8*a* having a large number of slits 22 at regular intervals and fixed to the rotation driving shaft 7, and which permits a controller to control the forward and reverse rotations of the motor 14 (where the reverse rotation proceeds for about 3 seconds).

In such a construction, the medal pieces A supplied from the medal piece polishing machine and stocked in the medal piece container 1 fall into the state where they are link to one another and form a bridge or the state where they press against the feed cylinder 4, especially by slipping down along the inclined surface 12. The bridge formed of the medal pieces A is unbalanced by the acceptance opening 4*a* owing to the rotation of the feed cylinder 4. Particularly the medal pieces A which slip down along the inclined surface 12 are accepted from the acceptance opening 4*a* into the feed cylinder 4, and the unbalanced medal pieces A are directly taken from the acceptance opening 4*a* into the feed cylinder 4. Then, the medal pieces A are delivered from the delivery opening 4*b* into the underlying chute 3 and are smoothly sent to the individual game machines B by the resupply conveyor 5.

In this case, when the medal piece A has engaged with the circumferential part of the feed cylinder 4 to render the motor overloaded, the friction plates 9, 9 slip into the unclutched state thereof. Thus, although the rotation driving shaft 7 is kept rotating, the feed cylinder 4 stops rotating. The :motor sensor 8 detects this situation, and rotates the motor 14 in the reverse direction for about 3 seconds. While the feed cylinder 4 is being reversely rotated for about 3 seconds owing to the pressed contact state of the friction plates 9, 9, the attitude of the engaging medal piece A around the feed cylinder 4 can be corrected. Thereafter, when the feed cylinder is rotated forwards again, the medal piece A can be favorably received.

Figure 7:
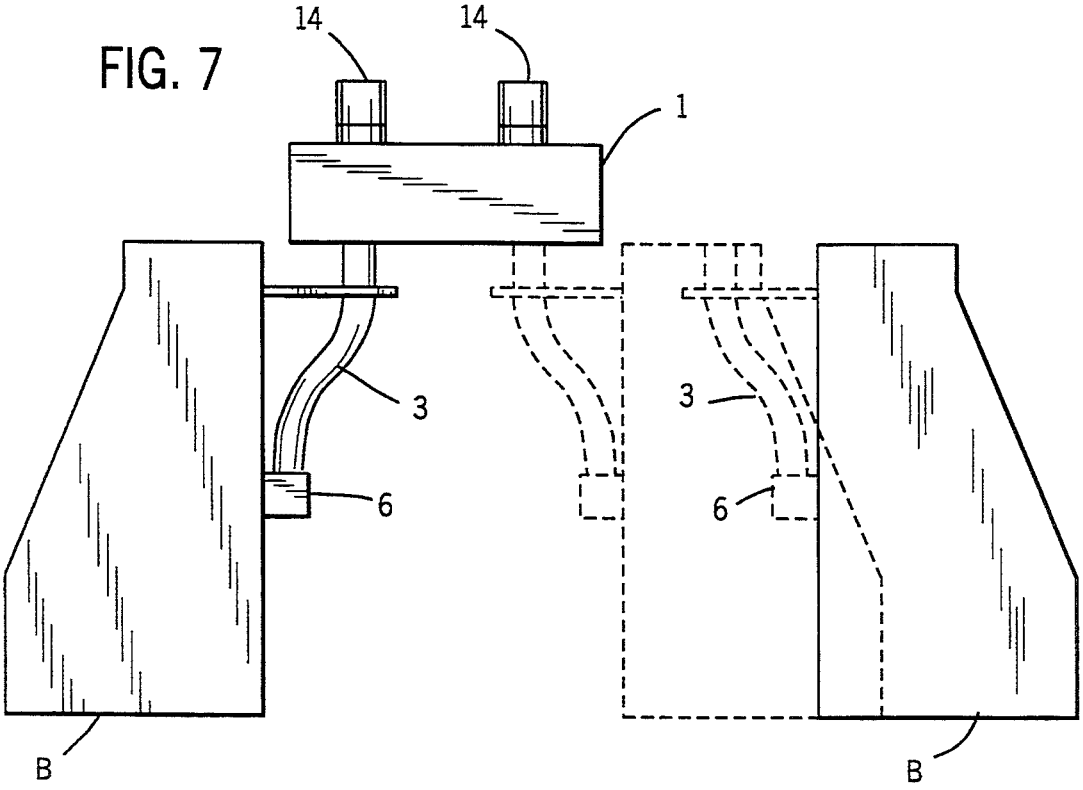
FIG. 7 is a front view showing another embodiment.

FIG. 7 illustrates another embodiment, which is constructed substantially similarly to the preceding embodiment as indicated by the same symbols as in the foregoing. A point of, difference is that each chute 3 is made of a flexible hose, the lower end part of which is connected to a medal piece introducing fixture 6 mounted on the rear part of a game machine B. Thus, in a case where the game machine B is to be taken out for such reason as adjustment or exchange, it can be taken out together with the chute 3 by detaching the upper end of this chute 3 from the side of a delivery opening 4*b*.

INDUSTRIAL APPLICATION

As thus far described, according to the present invention, the acceptance opening 4*a* of each feed cylinder 4 adapted to rotate can accept medal pieces A while unbalancing a bridge formed of such medal pieces, so that the medal pieces A can be smoothly delivered from a medal piece container 1 into each chute 3 through the feed cylinder 4. Accordingly, in a case where the medals are to be sent to game machines B, they can be smoothly sent from the chute 3 thereto through a resupply conveyor 5 or introducing fixtures 6. Moreover, when the medal piece A has engaged with the outer periphery of the feed cylinder 4 by way of example, the rotation of this feed cylinder 4 can be stopped due to friction plates 9 being allowed to slip, so that various components can be prevented from damage due to an overload. Further, the attitude of the engaging medal piece A can be corrected immediately thereafter while the feed cylinder 4 is being rotated in the reverse direction, whereby the medal pieces A can be fed reliably and favorably.

We claim:

1. A medal piece feed system for game machines, said medal piece feed system receiving medal pieces and thereafter feeding the medal pieces to a receiver for use with the game machines, said medal piece feed system comprising:

a container for receiving the medal pieces, said container having at least one hole formed at its bottom;

a chute underlying said hole and communicating with said receiver;

a feed cylinder having its lower part snugly inserted into said hole, said feed cylinder having an acceptance opening for accepting medal pieces therethrough, said acceptance opening being formed in a peripheral wall of said feed cylinder and facing the interior of said container, said feed cylinder further comprising a delivery opening formed on the bottom of said feed cylinder and communicating with said underlying chute for feeding said medal pieces to said receiver; and a motor having a rotation driving shaft means connected to said feed cylinder for rotating said feed cylinder about its cylindrical axis.

2. A medal piece feed system for game machines as defined in claim 1, wherein said medal piece are coin.

3. A medal piece feed system for game machines as defined in claim 1, wherein a conveyor for resupplying said medal pieces to said game machines is extended so as to directly underlie said each chute.

4. A medal piece feed system for game machines as defined in claim 1, wherein said chute is a flexible hose whose lower end is connected to a medal piece introducing fixture.

5. A medal piece feed system for game machines as defined in claim 1, wherein a motor condition sensor is installed on said rotation driving shaft means.

6. A medal piece feed system for game machines as defined in claim 5, wherein a clutch having friction plates is interposed between said rotation driving shaft means and said feed cylinder.

7. A medal piece feed system for game machines as defined in claim 6, wherein a torque can be set by a spring which resiliently compresses said friction plates.

* * * * *

UNITED STATES PATENT AND TRADEMARK OFFICE

CERTIFICATE OF CORRECTION

PATENT NO. : 5,390,923

DATED : February 21, 1995

INVENTOR(S) : Takatoshi Takemoto et al

It is certified that error appears in the above-indentified patent and that said Letters Patent is hereby corrected as shown below:

CLAIM 2, Col. 5, Line 6, after the word "piece" add the suffix "s"; CLAIM 2, Col. 5, Line 6, after the word "coin" add the suffix "s"; CLAIM 3, Col. 5, Line 10, delete the word "each".

Signed and Sealed this

Twenty-ninth Day of August, 1995

*Attest:*

Bruce Lehman

BRUCE LEHMAN

*Attesting Officer*

*Commissioner of Patents and Trademarks*